US011585598B2

(12) United States Patent
Farges et al.

(10) Patent No.: US 11,585,598 B2
(45) Date of Patent: Feb. 21, 2023

(54) OPERATION OF NATURAL GAS LIQUIDS STABILIZER COLUMN

(71) Applicant: L'Air Liquide, Societe Anonyme pour l'Etude et l'Exploitation des Procedes Georges Claude, Paris (FR)

(72) Inventors: Oriane Farges, Houston, TX (US); Michael A. Turney, Houston, TX (US); Pierre Costa De Beauregard, Houston, TX (US)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 146 days.

(21) Appl. No.: 17/127,940

(22) Filed: Dec. 18, 2020

(65) Prior Publication Data

US 2022/0196324 A1 Jun. 23, 2022

(51) Int. Cl.
*C10G 5/06* (2006.01)
*F25J 3/02* (2006.01)

(52) U.S. Cl.
CPC ..... *F25J 3/0233* (2013.01); *C10G 5/06* (2013.01); *F25J 3/0209* (2013.01); *C10G 2300/1025* (2013.01); *F25J 2200/02* (2013.01)

(58) Field of Classification Search
None
See application file for complete search history.

(56) References Cited

U.S. PATENT DOCUMENTS

| | | | | |
|---|---|---|---|---|
| 6,604,380 | B1 * | 8/2003 | Reddick | F25J 3/064 62/620 |
| 2005/0005636 | A1 * | 1/2005 | Schroeder | F25J 3/0233 62/620 |
| 2006/0130520 | A1 * | 6/2006 | Patel | F25J 3/0233 62/620 |
| 2013/0333416 | A1 * | 12/2013 | Lourenco | F25J 3/0233 62/611 |
| 2015/0219394 | A1 * | 8/2015 | Russeff | C10G 65/00 62/620 |
| 2016/0340596 | A1 * | 11/2016 | Matteucci | B01D 53/04 |

* cited by examiner

*Primary Examiner* — Philip Y Louie
(74) *Attorney, Agent, or Firm* — Justin K. Murray

(57) ABSTRACT

A method for improved operation of a natural gas liquids stabilizer column, particularly a small-scale, is provided. The method can include the steps of: introducing a first feed stream comprising heavy hydrocarbons and natural gas to a stabilizer column to produce a top gas and a bottoms liquid, wherein the top gas has a higher concentration of natural gas as compared to the first feed stream, and the bottoms liquid has a higher concentration of heavy hydrocarbons as compared to the first feed stream; introducing a second feed stream into the stabilizer column, wherein the second feed stream has a higher concentration of natural gas as compared to the first feed stream, wherein the second feed stream is at a warmer temperature than the first feed stream when introduced into the stabilizer column, wherein the second feed stream is a gaseous stream; withdrawing the top gas from a top portion of the stabilizer column; withdrawing the bottoms liquid from a bottom portion of the stabilizer column; and sending at least a portion of the bottoms liquid to a liquid storage tank.

11 Claims, 3 Drawing Sheets

OPERATION OF NATURAL GAS LIQUIDS STABILIZER COLUMN

TECHNICAL FIELD

The present invention generally relates to a method and apparatus for improving the operation of a natural gas liquids stabilizer column. Certain embodiments of the invention are particularly useful for reducing the top temperature of the stabilizer column without the use of a top condenser or additional equipment.

BACKGROUND OF THE INVENTION

Natural gas liquids (.NGL) removal and stabilization is standard industry practice in upstream oil and gas activities. The objective is to remove the heaviest hydrocarbons from natural gas, often coming from a wellhead, and which would condense in downstream natural gas treatment equipment. Heavy hydrocarbons are then separated into lighter ($C_{4-}$) and heavier ($C_{5+}$) compounds and sold as by-products (NGL).

In the liquefied natural gas (LNG) industry, NGL recovery systems are also present; particularly in large scale plants. The feed gas, generally pipeline quality natural gas, contains less heavy hydrocarbons than natural gas coming directly from a wellhead (usually hydrocarbon dew point specification is <10° C.); however, the heavy compounds still need to be removed to avoid any freezing at cryogenic temperatures. The standard solution is to add a scrubber column to remove most of the $C_{4+}$ from the natural gas and send the bottom liquids to a stabilizer column that separates the light ends from the C5+ hydrocarbons. The bottom liquid can be stored under ambient conditions and sold as NGL.

For large scale plants, the top vapor can be recovered mixed with the process gas or sent back to the pipeline or further processed in additional columns such as a deethanizer etc. . . . .

However, for small-scale LNG plants (generally between <50 and 300 tons per day), the design is generally more CAPEX oriented, which means that the number of equipment is reduced as much as possible. However, depending on the heavy hydrocarbon content, and especially benzene, a scrubber and stabilizer columns may be necessary. In that case, the liquid bottom of the stabilizer can still be sold as NGL while the top vapor is generally used as fuel gas for the plant.

FIG. 1 provides an embodiment known heretofore. Natural gas 2, typically from a natural gas pipeline, is sent to a pretreatment stage 10 to remove items such as water and $CO_2$ that might freeze downstream. This pretreated stream 12 is then sent to a cold box and scrubber 20, wherein the natural gas is separated out and liquefied to form liquefied natural gas (LNG) 22 and subsequently stored in LNG storage 30. Heavy hydrocarbons 24 are removed from the cold box and scrubber 20, expanded in valve V1, and then introduced into the NGL stabilizer column 40. Heavy hydrocarbon stream 24 contains primarily $C_{4+}$ components and to a lesser extent, some methane, ethane and propane.

In the embodiment shown, a top gas 42, which contains primarily butane, is withdrawn from a top section of the stabilizer column 40, and then cooled in top condenser 45 before the resulting stream is sent to phase separator 50, wherein gas stream 52 is separated and likely used as fuel gas, with liquid stream 54 being sent back to the stabilizer column 40 as a reflux stream.

The bottoms liquid stream 44, which contains primarily natural gas liquids (NGL), is withdrawn from a bottom section of the stabilizer column 40, and then warmed in bottom reboiler before the resulting stream is sent to a second phase separator 60, wherein second gas stream 62 is separated and recycled back to the stabilizer column 40. The remaining liquid 64 is withdrawn from the second phase separator 60, and sent to NGL storage 70 after optional air cooling (not shown) and then flowing through valve V2.

Stabilizer units for LNG plants typically operate under warm conditions, which are between about 100 to 130° C. at the bottom of the column and about 20 to 50° C. at the top, and the columns are usually mounted with a bottom reboiler and a top condenser. The reboiler is used to ensure that the bottom liquid (NGL) is stable at its storage conditions (i.e. the Reid Vapor Pressure is lower than 1 bar). The top condenser reduces the saturation temperature of the top vapor by recovering some heavy compounds present at the top of the column. Having a top condenser generally also requires a separator drum and a pump to send the reflux back in the column. Unfortunately, this extra equipment for the top gas introduces excess equipment costs and complexity for a relatively low flow.

It is possible to operate the stabilizer without any reflux, which is shown in FIG. 2. As shown in FIG. 2, the top condenser 45, phase separator 50, and liquid pump have been removed. However, the vapor coming out from the top of the column is saturated at a higher temperature, between 60° C. and 90° C., and will condense as the pipeline carrying the vapor cools down. Therefore, this stream cannot be sent directly to the fuel gas system and this would require additional equipment to get rid of the liquid, thereby making it an inefficient solution.

Therefore, it would be beneficial to provide a process and apparatus for small-scale LNG plants that could provide the ability to stabilize the NGL from the bottoms liquid of the scrubber at a high efficiency while also being more economically feasible.

BRIEF SUMMARY OF THE INVENTION

The present invention is directed to a device and a method that satisfies at least one of these needs. The objective of the current invention is to be able to reduce the temperature at the top of stabilizer column and thereby be able to collect the top gas of the stabilizer column without needing to include a condenser or other extraneous equipment. In one embodiment, this can be achieved by introducing a natural gas bypass stream that is upstream of the cold box and scrubber to an intermediate level of the stabilizer column. This gaseous stream is preferably letdown (and cooled via Joule Thompson cooling) prior to introduction to the stabilizer column, wherein the natural gas naturally rises towards the top of the column and subsequently reduces the top temperature from about 60-80° C. to about 40° C., without altering the performance of the column. Another advantage of this system is that the natural gas stream adds some heat to the column, which helps reduce the duty of the reboiler.

In one embodiment, a method for improved operation of a natural gas liquids stabilizer column is provided. The method can include the steps of: introducing a first feed stream comprising heavy hydrocarbons and natural gas to a stabilizer column under conditions effective for producing a top gas and a bottoms liquid, wherein the top gas has a higher concentration of natural gas as compared to the first feed stream, and the bottoms liquid has a higher concentration of heavy hydrocarbons as compared to the first feed stream; introducing a second feed stream into the stabilizer column, wherein the second feed stream has a higher concentration of natural gas as compared to the first feed stream, wherein the second feed stream is at a warmer temperature than the first feed stream when introduced into the stabilizer column, wherein the second feed stream is a gaseous stream; withdrawing the top gas from a top portion of the stabilizer column; withdrawing the bottoms liquid from a bottom portion of the stabilizer column; and sending at least a portion of the bottoms liquid to a liquid storage tank.

In optional embodiments of the method for improved operation of a natural gas liquids stabilizer column:

- the method can also include the step of adjusting a temperature at the top portion of the stabilizer column by adjusting a flow rate of the second feed stream introduced to the stabilizer column;
- the method can also include the step of lowering a temperature at the top portion of the stabilizer column by increasing a flow rate of the second feed stream introduced to the stabilizer column;
- the method can also include the step of utilizing the top gas as a fuel gas in a combustion reaction;
- the top gas is used as a fuel gas without having been sent to a condenser at a location downstream the stabilizer column and upstream the combustion reaction;
- the first feed stream comprises a two-phase fluid that is primarily liquid;
- the first feed stream is introduced into the stabilizer column at a location above where the second feed stream is introduced;
- the first feed stream is received from a cold box and scrubbing unit;
- the first feed stream is formed by introducing a natural gas stream into a cold box and scrubbing unit under conditions effective for producing liquefied natural gas and a heavy hydrocarbons stream, wherein the first feed stream comprises the heavy hydrocarbons stream;
- the first feed stream and the second feed stream are derived from a common source of natural gas;
- the method can also include the steps of: withdrawing a natural gas stream from a natural gas pipeline; treating the natural gas stream to remove water and carbon dioxide to form a pretreated natural gas stream; sending a first portion of the pretreated natural gas stream to a cold box and scrubbing unit under conditions effective for producing liquefied natural gas and a heavy hydrocarbons stream, wherein the heavy hydrocarbons stream is introduced to the stabilizer column as the first feed stream, wherein a second portion of the pretreated natural gas stream is introduced to the stabilizer column as the second feed stream; and/or
- the method can also include an absence of the step of condensing a portion of the top gas for use as a reflux liquid in the stabilizer column.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 3:
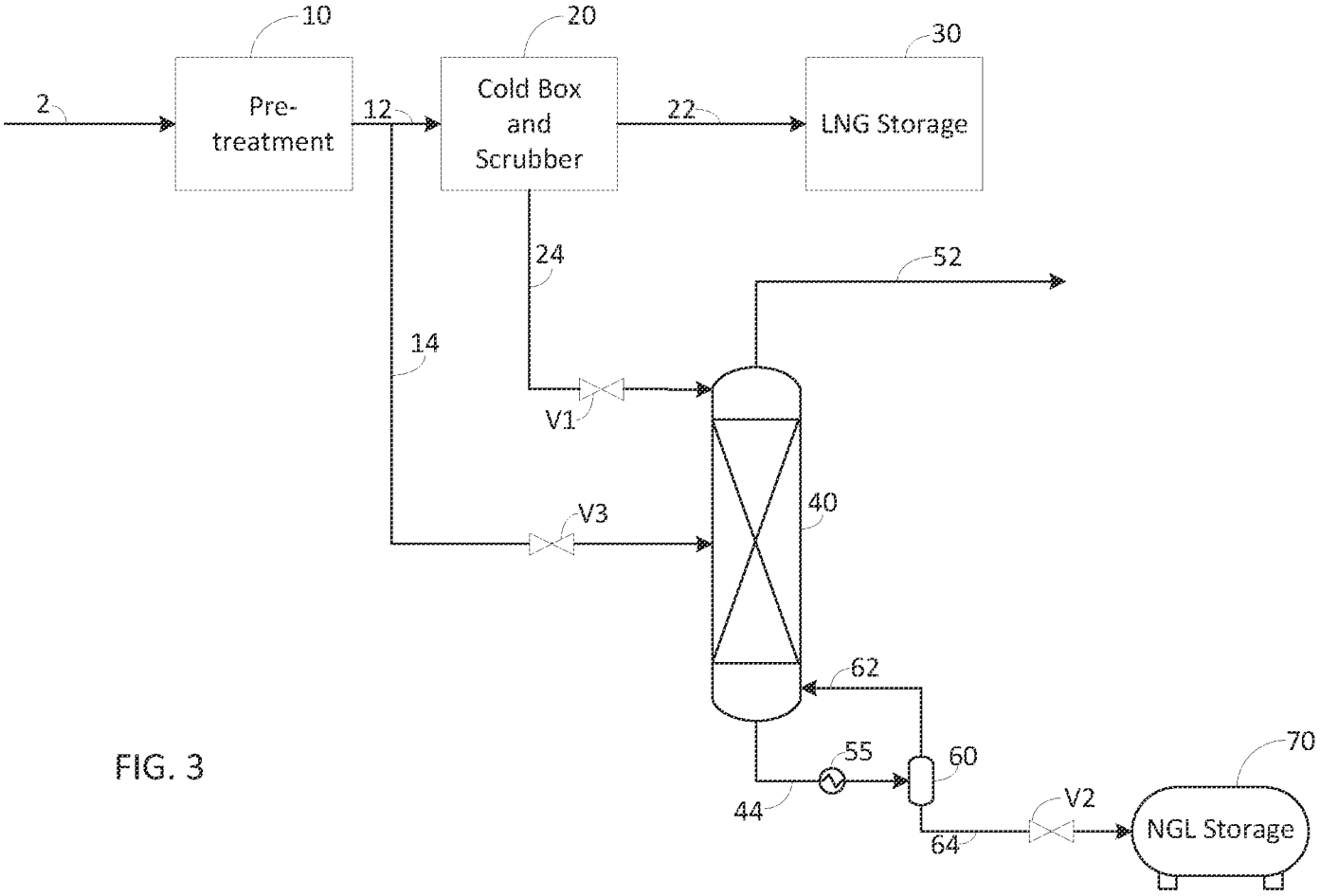
FIG. 3 is a process flow diagram of an embodiment of the present invention.

Now turning to FIG. 3, natural gas 2, typically from a natural gas pipeline, is sent to pretreatment stage 10 to remove components that might freeze downstream. This pretreated stream 12 is then sent to cold box and scrubber 20, wherein the natural gas is separated out and liquefied to form liquefied natural gas (LNG) 22 and subsequently stored in LNG storage 30. Heavy hydrocarbons 24 are removed from the cold box and scrubber 20, expanded in valve V1, and then introduced into the top of NGL stabilizer column 40.

In one embodiment, natural gas bypass stream 14 is letdown across valve V3 and arrives in the stabilizer column 40 as superheated vapor at around 30° C. The heavy hydrocarbons 24 fed to the stabilizer column is a bit colder at around 16° C. and is a two-phase flow containing some methane, but also higher amount of heavy hydrocarbons such as C3+, which are being recovered at the bottom of the stabilizer column as NGL.

Consequently, the natural gas bypass vapor stream 14 will preferably stay in the vapor phase under the operating conditions of the stabilizer column, thereby reaching the top without condensing. Furthermore, since the natural gas bypass stream is at a warmer temperature than the heavy hydrocarbons 24 coming from the cold box/scrubber 20, the natural gas bypass stream 14 adds additional heat into the stabilizer column 40, thereby lowering the heat duty needed by the bottom reboiler 55, which further saves operational costs.

In the embodiment shown, top gas 52, which contains primarily natural gas, is withdrawn from a top section of the stabilizer column 40, and then used for other purposes, such as being used as fuel gas. In one embodiment, the flowrate of natural gas bypass vapor stream 14 can also be adjusted to match the fuel gas balance needed for the facility.

The bottoms liquid stream 42, which contains primarily natural gas liquids (NGL), is withdrawn from a bottom section of the stabilizer column 40, and then warmed in bottom reboiler 55 before the resulting stream is sent to a second phase separator 60, wherein second gas stream 62 is separated and recycled back to the stabilizer column 40. The remaining liquid 64 is withdrawn from the second phase separator 60, and sent to NGL storage 70 after optional air-cooling (not shown) and flowing through valve V2.

While the embodiment shown in FIG. 3 shows the natural gas bypass stream 14 coming after pretreatment stage 10, the invention is not to be so limited. For example, those of ordinary skill in the art will recognize that the natural gas bypass stream 14 can be taken from any suitable location that is upstream cold box/scrubber 20.

Figure 1:
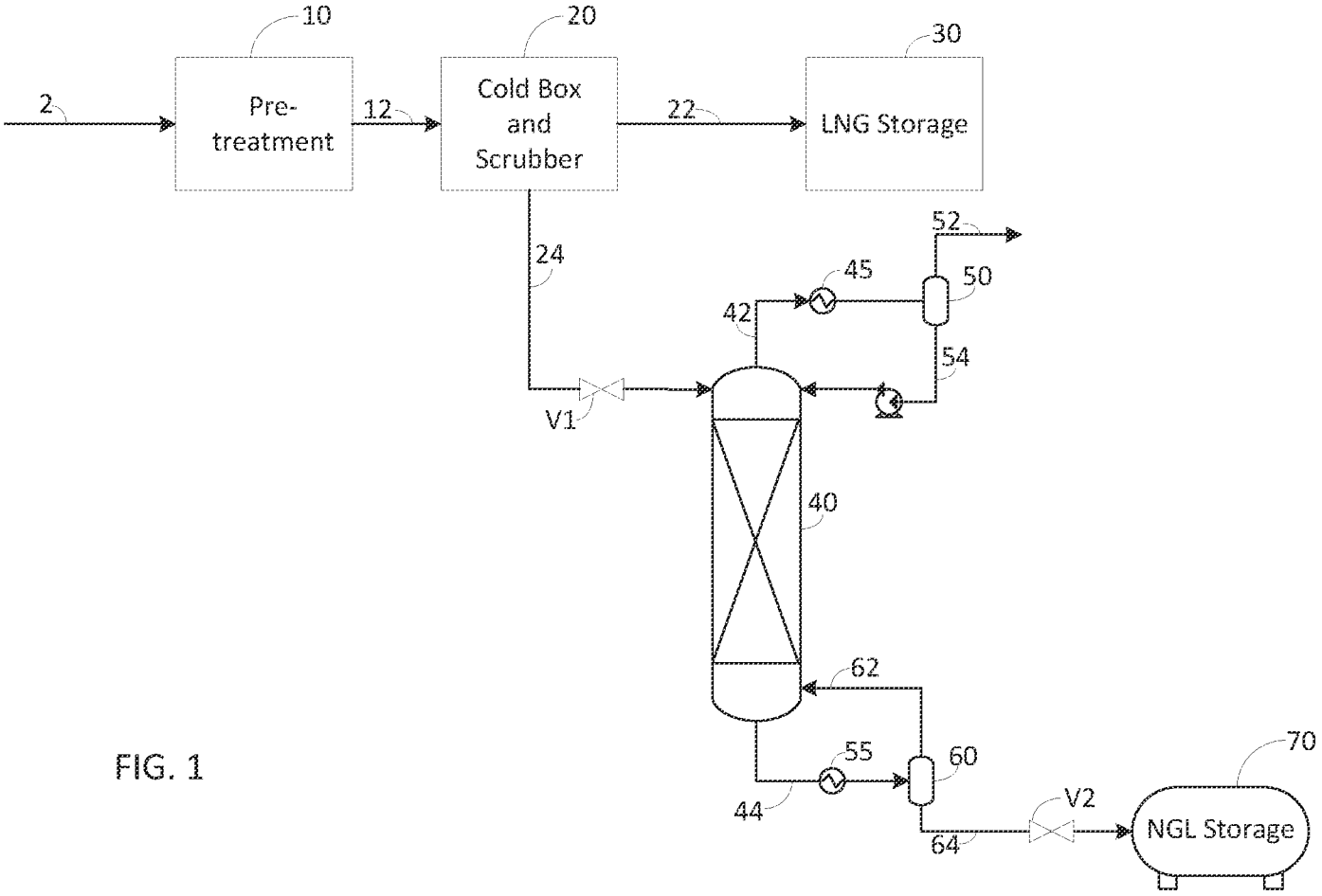
FIG. 1 is a process flow diagram of an embodiment of the prior art.
Figure 2:
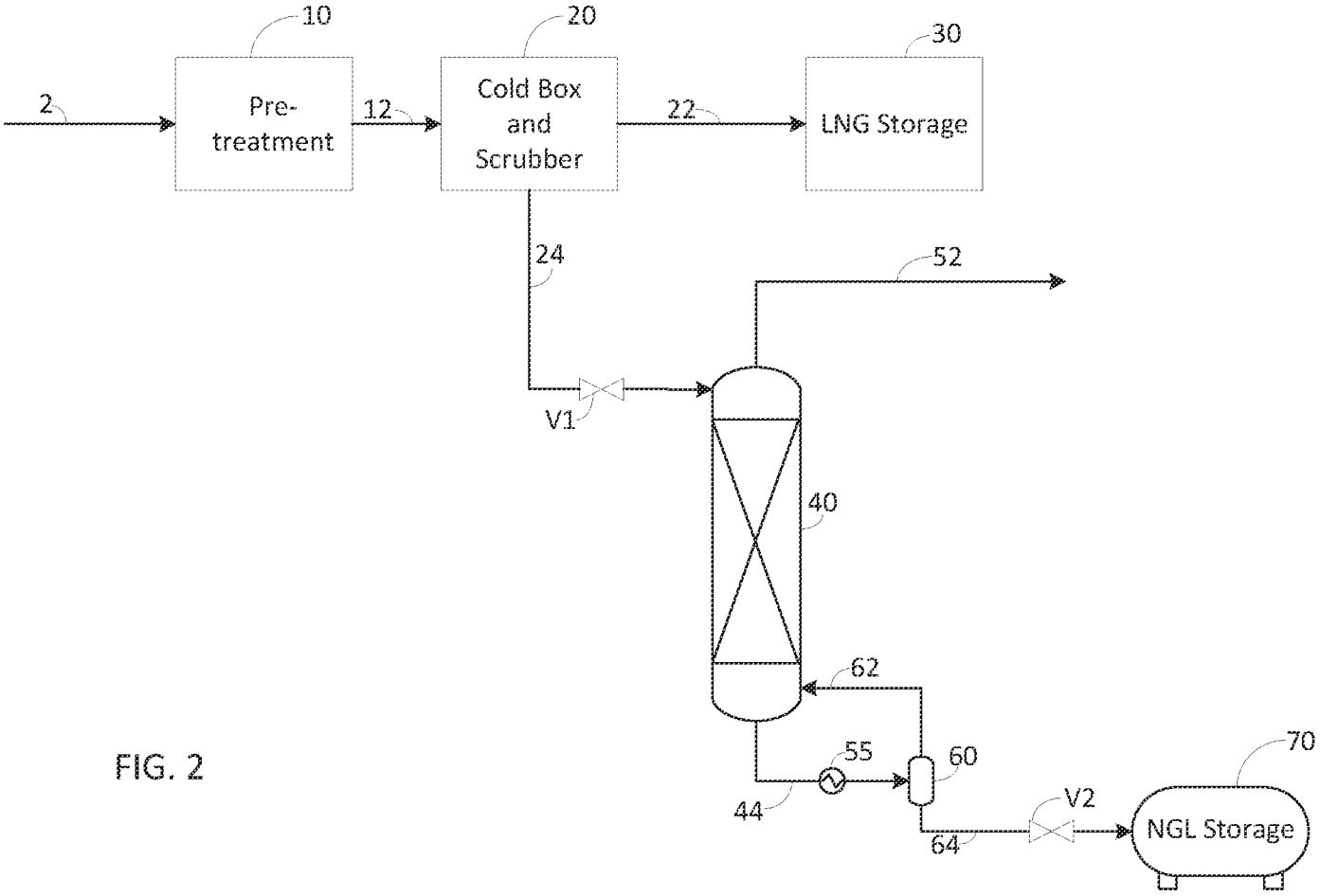
FIG. 2 is a process flow diagram of another embodiment of the prior art

A comparison of the performances of a stabilizer as per FIG. 2 arrangement and FIG. 3 arrangement is presented in Table I below.

TABLE 1

Performance Comparison of Prior Art and an Embodiment of the Present Invention

| | | Scheme FIG. (2) | | Scheme FIG. (3) | | |
|---|---|---|---|---|---|---|
| | | Nominal | Rich | Nominal | Nominal | Rich |
| Stabilizer - number of trays | | 10 | 10 | 10 | 10 | 10 |
| Stabilizer Inlet pressure | bara | 7 | 7 | 7 | 7 | 7 |
| NG by-pass | Nm3/h | — | — | 100 | 300 | 300 |
| Inlet Flow from scrubber | Nm3/h | 62 | 402 | 62 | 62 | 402 |
| Inlet Temp. from scrubber | ° C. | 16 | 11 | 16 | 16 | 11 |
| Top Flow | Nm3/h | 39 | 353 | 141 | 341 | 650 |
| Top Temp | ° C. | 82 | 69 | 39 | 15 | 46 |
| Bottom Flow | Nm3/h | 23 | 50 | 21 | 21 | 52 |
| Bottom Temperature | ° C. | 118 | 120 | 119 | 119 | 120 |
| Reboiler duty | kW | 17 | 112 | 16 | 12 | 105 |
| NGL RVP (100° F.) | bara | 0.8 | 0.8 | 0.8 | 0.8 | 0.8 |
| Vapor Flow/Fuel need | | 9% | 72% | 17% | 30% | 95% |

Each scheme was studied using two different natural gas feed compositions: a nominal composition and a composition rich in heavy hydrocarbons. The composition rich in heavy hydrocarbons is provided below:

TABLE II

Compositions of Various Flows for Rich Composition

| Stream | Rich Case NG to Cold Box and Scrubber | Heavy Hydrocarbon Condensates from Cold Box and Scrubber to Stabilizer | Stabilized NGL Composition |
|---|---|---|---|
| Stream Number | 12; 14 | 24 | 64 |
| Mole Fractions | | | |
| Methane | 88.9974% | 13.4068% | 0.0000% |
| Ethane | 4.7686% | 3.8414% | 0.0000% |
| Propane | 2.0159% | 5.8473% | 0.0001% |
| i-Butane | 1.5452% | 17.2930% | 0.0091% |
| n-Butane | 1.0745% | 21.4362% | 0.0491% |
| i-Pentane | 0.4912% | 21.1063% | 26.8681% |
| n-Pentane | 0.2456% | 10.8829% | 31.0378% |
| n-Hexane | 0.0819% | 3.7254% | 24.6938% |
| Nitrogen | 0.7266% | 0.0391% | 0.0000% |
| CO2 | 0.0000% | 0.0000% | 0.0000% |
| Oxygen | 0.0000% | 0.0000% | 0.0000% |
| H2O | 0.0000% | 0.0000% | 0.0000% |
| Benzene | 0.0225% | 1.0245% | 6.8106% |
| n-Heptane | 0.0205% | 0.9315% | 6.9274% |
| n-Octane | 0.0102% | 0.4657% | 3.6040% |
| n-Nonane | 0.0000% | 0.0000% | 0.0000% |

The column was designed to reach 0.8 bar RVP at the bottom and the column pressure could not be lower than 7 bara as the top of the column is sent to a fuel gas system at 6 bara. As the number of trays does not have a major impact on the performances of the column, the only degree of freedom consists in adjusting the reboiler duty to reach the targeted NGL RVP. In the embodiment shown, the natural gas by-pass 14 used was at 28 bara and 40° C., letdown to 7 bara and a temperature of 30° C., and injected on the 5th tray of the stabilizer column 40.

Results:

The addition of by-pass natural gas cools down the column top temperature significantly.

The reboiler duty drops by 6%.

The by-pass flow can be adjusted to reach the desired temperature of the vapor head leaving the top of the column.

If using the top gas as fuel gas, the top gas of the prior art does not contain enough heat value, and will need to be mixed with additional natural gas to be useful. As such, mixing the natural gas within the stabilizer column provides the synergistic results noted above without using large additional amounts of natural gas.

In a preferred embodiment, the gas leaving the top of the column is a saturated vapor. If it is not cool enough (it needs to be close to ambient temperature), it will partially condense. This is one benefit from the Joule-Thompson effect from V3 (i.e., temperature of stream 14 is slightly reduced upon expansion across V3).

Also, after injecting the separate NG bypass into the column, the vapor composition inside the column changes and becomes much lighter, thereby reducing the equilibrium temperature at the top of the column because there are less heavy hydrocarbons.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step or reversed in order.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary a range is expressed, it is to be understood that another embodiment is from the one.

Optional or optionally means that the subsequently described event or circumstances may or may not occur. The description includes instances where the event or circumstance occurs and instances where it does not occur.

Ranges may be expressed herein as from about one particular value, and/or to about another particular value. When such particular value and/or to the other particular value, along with all combinations within said range.

All references identified herein are each hereby incorporated by reference into this application in their entireties, as well as for the specific information for which each is cited.

What is claimed is:

1. A method for improved operation of a natural gas liquids stabilizer column, the method comprising the steps of:

introducing a first feed stream comprising heavy hydrocarbons and natural gas to a stabilizer column under conditions effective for producing a top gas and a bottoms liquid, wherein the top gas has a higher concentration of natural gas as compared to the first feed stream, and the bottoms liquid has a higher concentration of heavy hydrocarbons as compared to the first feed stream;

introducing a second feed stream into the stabilizer column, wherein the second feed stream has a higher concentration of natural gas as compared to the first feed stream, wherein the second feed stream is at a warmer temperature than the first feed stream when introduced into the stabilizer column, and wherein the second feed stream is a gaseous stream;

withdrawing the top gas from a top portion of the stabilizer column;

withdrawing the bottoms liquid from a bottom portion of the stabilizer column;

sending at least a portion of the bottoms liquid to a liquid storage tank; and adjusting a temperature at the top portion of the stabilizer column by adjusting a flow rate of the second feed stream introduced to the stabilizer column, wherein the heavy hydrocarbons $C_{2+}$ hydrocarbons.

2. The method of claim 1, further comprising the step of lowering a temperature at the top portion of the stabilizer column by increasing a flow rate of the second feed stream introduced to the stabilizer column.

3. The method of claim 1, further comprising the step of utilizing the top gas as a fuel gas in a combustion reaction.

4. The method of claim 3, wherein the top gas is used as a fuel gas without having been sent to a condenser at a location downstream of the stabilizer column and upstream of the combustion reaction.

5. The method of claim 1, wherein the first feed stream comprises a two-phase fluid that is primarily liquid.

6. The method of claim 1, wherein the first feed stream is introduced into the stabilizer column at a location above where the second feed stream is introduced.

7. The method of claim 1, wherein the first feed stream and the second feed stream are derived from a common source of natural gas.

8. The method of claim 1, further comprising the steps of:

withdrawing a natural gas stream from a natural gas pipeline;

treating the natural gas stream to remove water and carbon dioxide to form a pretreated natural gas stream;

sending a first portion of the pretreated natural gas stream to a cold box and scrubbing unit under conditions effective for producing liquefied natural gas and a heavy hydrocarbons stream, wherein the heavy hydrocarbons stream is introduced to the stabilizer column as the first feed stream, and wherein a second portion of the pretreated natural gas stream is introduced to the stabilizer column as the second feed stream.

9. The method of claim 1, further comprising an absence of condensing a portion of the top gas for use as a reflux liquid in the stabilizer column.

10. A method for improved operation of a natural gas liquids stabilizer column, the method comprising the steps of:

introducing a first feed stream comprising heavy hydrocarbons and natural gas to a stabilizer column under conditions effective for producing a top has and a bottom liquid, wherein the top has a higher concentration of natural has as compared to the first feed stream, and the bottoms liquid has a higher concentration of heavy hydrocarbons as compared to the first feed stream;

introducing a second feed stream into the stabilizer column, wherein the second feed stream has a higher concentration of natural gas as compared to the first feed stream, wherein the second feed stream is at a warmer temperature than the first feed stream when introduced into the stabilizer column, and wherein the second feed stream is a gaseous stream;

withdrawing the top gas from a top portion of the stabilizer column, withdrawing the bottoms liquid from a bottom portion of the stabilizer column; and sending at least a portion of the bottoms liquid to a liquid storage tank;

wherein the first feed stream is received from a cold box and scrubbing unit and wherein the heavy hydrocarbons comprise $C_{2+}$ hydrocarbons.

11. A method for improved operation of a natural has liquids stabilizer column, the method comprising the steps of introducing a first feed stream comprising heavy hydrocarbons and natural has to a stabilizer column under conditions effective for producing a top has and a bottoms liquid, wherein the top gas has a higher concentration of natural has as compared to the first feed stream, and the bottoms liquid has a higher concentration of heavy hydrocarbons as compared to the first feed stream;

introducing a second feed stream into the stabilizer column, wherein the second feed stream has a higher concentration of natural has as compared to the first feed stream, wherein the second feed stream is at a warmer temperature than the first feed stream when introduced into the stabilizer column, and wherein the second feed stream is a gaseous stream;

withdrawing the top has from a top portion of the stabilizer column;

withdrawing the bottoms liquid from a bottom portion of the stabilizer column; and sending at least a portion of the bottoms liquid to a liquid storage tank, wherein the first feed stream is formed by introducing a natural gas stream into a cold box and scrubbing unit under conditions effective for producing liquefied natural gas and a heavy hydrocarbons stream, wherein the first feed stream comprises the heavy hydrocarbon stream and wherein the heavy hydrocarbons comprise $C_{2+}$ hydrocarbons.

* * * * *